United States Patent [19]

Fontana

[11] 4,324,024

[45] Apr. 13, 1982

[54] ADJUSTING AND LOCKING DEVICE FOR WATCH BRACELETS

[76] Inventor: Fernando Fontana, Via Piave, 96-Sesto Calende (Varese), Italy

[21] Appl. No.: 80,779

[22] Filed: Sep. 28, 1979

[30] Foreign Application Priority Data

Oct. 2, 1978 [IT] Italy ..... 22931/78 [U]

[51] Int. Cl.[3] ..... A44B 11/12; A44B 11/26

[52] U.S. Cl. ..... 24/170; 24/206 B; 24/230 AL; 24/265WS; 24/323

[58] Field of Search ..... 24/206 B, 206 R, 170, 24/230 AL, 265 WS, 73 R, 73 A, 73 WW, 73 TL, 73 PH, 77 R, 78, 169, 317, 323, 324

[56] References Cited

U.S. PATENT DOCUMENTS

| | | | |
|---|---|---|---|
| 1,874,464 | 8/1932 | Davis et al. . | |
| 3,319,308 | 5/1967 | Williams | 24/206 R |
| 3,765,064 | 10/1973 | Hoober et al. | 24/230 AL |
| 4,190,934 | 3/1980 | Wildi | 24/230 AL |

FOREIGN PATENT DOCUMENTS

| | | | |
|---|---|---|---|
| 801465 | 9/1936 | France | 24/230 AL |
| 964535 | 9/1950 | France | 24/265 WS |
| 1411137 | 9/1965 | France | 24/170 |
| 268086 | 3/1927 | United Kingdom | 24/265 WS |

*Primary Examiner*—Alexander Grosz
*Attorney, Agent, or Firm*—Martin Smolowitz

[57] ABSTRACT

The device comprises a slide having a bottom and a pair of opposite sides. The bottom is adapted to receive the end of the bracelet to be lengthened or shortened in a slidable and adjustable manner. An eccentric shaft is pivotally connected to said opposite sides of the slide in order to lock the bracelet in its adjusted position and is provided with a screw head which can be rotated by means of a screw-driver. Reliefs and recesses are provided in order to prevent the bracelet from sliding.

1 Claim, 9 Drawing Figures

Fig. 1
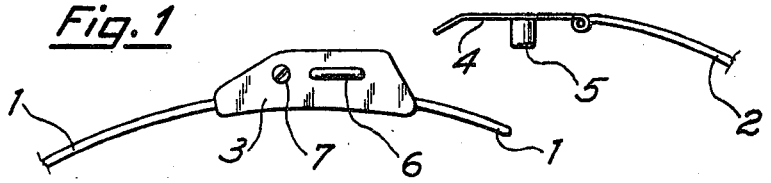
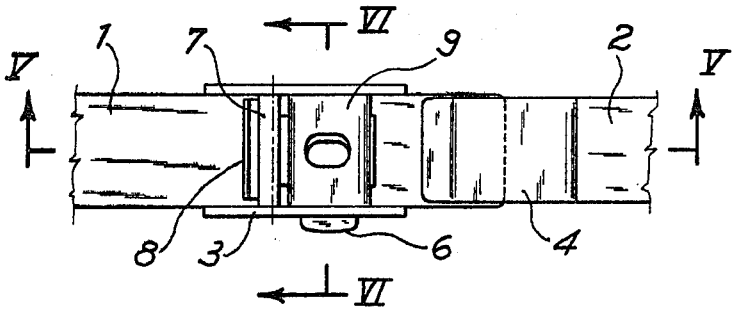
Fig. 2
Fig. 3
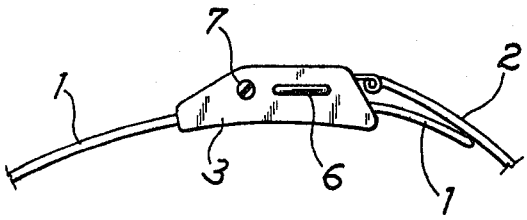
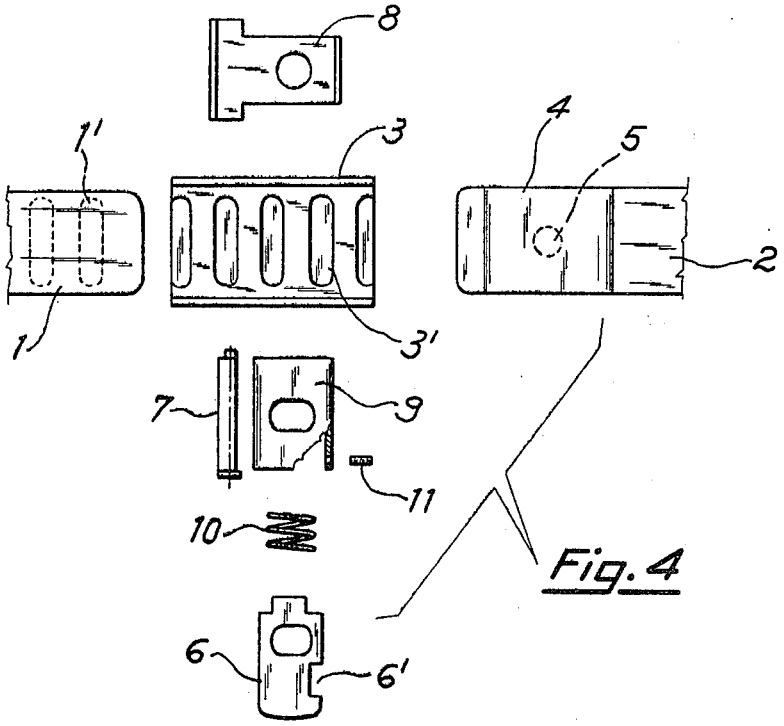
Fig. 4

ADJUSTING AND LOCKING DEVICE FOR WATCH BRACELETS

It is the object of this invention to provide an adjusting and locking device for watch bracelets characterized in that it can be applied both on bracelets made of metal and on bracelets made of leather or other materials.

It is known that the watch bracelets are usually made of metal, precious or not, or else of leather or other materials.

In order to adjust and lock metal bracelets, metal devices are employed permitting the diameter of the bracelet or belt to be changed according to the dimensions of the arm to which the bracelet is to be applied.

In order to adjust and lock leather bracelets, metal buckles or clasps are employed comprising on the one hand a little buckle with hook while on the other hand the bracelet or belt intended to cooperate with the hook is simply provided with holes aligned and spaced apart permitting the bracelet or belt to be fitted more or less for adjustment and locking purposes.

The leather bracelet or belt provided with a buckle is well known and it differs from the metal one for its function and aesthetic appearance. Thus, the associated adjusting and locking devices are quite different.

The adjusting and locking device according to the present invention aims to provide a simple and inexpensive means which can be applied both to bracelets made of metal and to bracelets made of leather or other materials, e.g. synthetic materials.

The device substantially comprises a slide having a bottom and a pair of opposite sides, which bottom is designed to receive the end of the bracelet to be lengthened or shortened in a slidable and adjustable manner. In order to clasp the bracelet into its seat after it has been adjusted the slide supports a short distance from the bottom thereof and parallel thereto an eccentric shaft pivotally connected to the opposite sides of the slide and provided with a screw head extending from one of said sides such that as it is rotated by means of a small screwdriver it applies an increasing pressura on the bracelet positioned between the bottom of the slide and the eccentric shaft until the bracelet is firmly fastened to the slide. The unclasping of the bracelet occurs by operating in a reverse manner thereby permitting the adjustment to be changed.

Since the bracelet is longitudinally formed of two complementary half sections attached to the watch these half sections will meet with one another at the center of the bracelet where they are to be clasped in order to lock the bracelet. The clasping and locking means is formed of a conventional detent carried on a half section of the bracelet, i.e. that carrying the slide and of a metal plate carried on the other half section and below which a tooth projects which is intended to engage the detent which is generally under the action of a spring and is provided externally with a release push-button.

In order that the slide cannot spontaneously slide after it has been adjusted and locked, the slide bottom on which the bracelet seats is provided with recesses, reliefs or the like adapted to prevent a sliding movement. Furthermore, below the eccentric shaft a blade is positioned which increases the pressure surface contacting the bracelet.

If the bracelet is made of metal, in the adjusting and locking area complementary reliefs and recesses can be provided which are intended to cooperate with those provided on the slide for anchoring the bracelet. If, on the contrary, the bracelet is made of leather or plastic material the recesses or reliefs are not necessary.

Other characteristics will be apparent from the following description and the accompanying drawing, in which:

FIG. 1 is a side view of the device according to the invention during the locking step;

FIG. 2 is a top plan view of the device of FIG. 1;

FIG. 3 shows the device of FIG. 1, after the locking operation;

FIG. 4 is an exploded view of the device;

Figure 5:
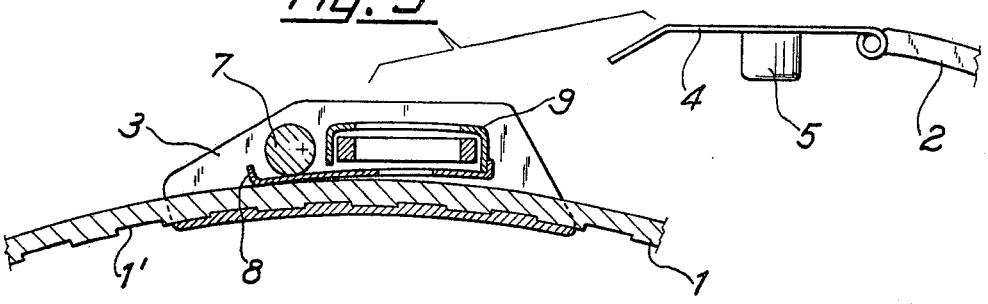
FIG. 5 is a sectional view taken along the line V—V of of FIG. 2 with the device being represented in an enlarged scale.
Figure 6:
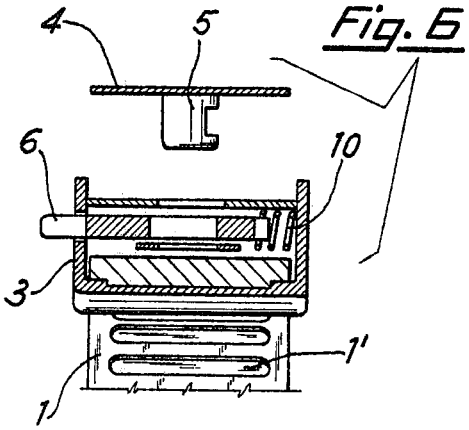
FIG. 6 is a sectional view taken along the line VI—VI of FIG. 2 with the device being represented in an enlarged scale and in a released position.
Figure 7:
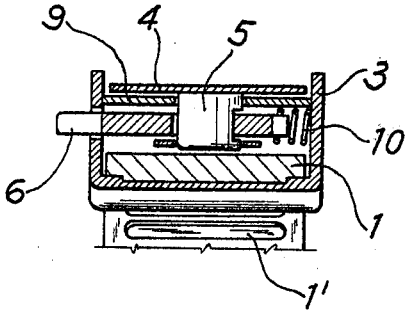
FIG. 7 shows the device of FIG. 6, but in a clasped position.
Figure 8:
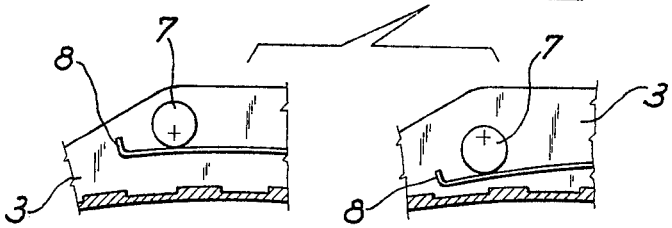
FIG. 8 is a diammetrical view illustrating the eccentric shaft urging on the blade interposed for fitting and anchoring the bracelet in two different positions, i.e. in a rest position and in an engaged position.
Figure 9:
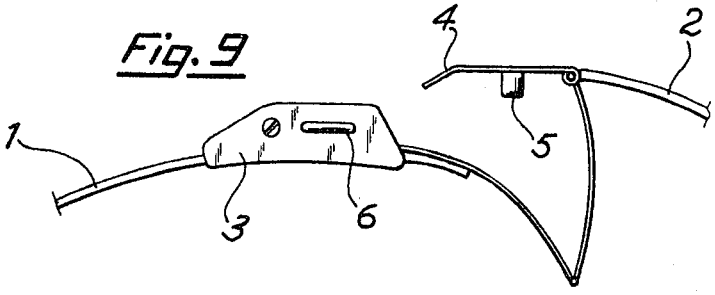
FIG. 9 shows the device in a released position, applied to a bracelet provided with a conventional book-like security element.

The bracelet generally comprises two portions hinged to the watch which meet at the center where they can be adjusted and clasped in order to lock the bracelet or belt. The portion 1 of the bracelet intended to be complemented by the portion 2 carries adjusting and locking slide 3 while to the portion 2 a plate 4 is pivotally connected, under which the hook 5 projects and the slide 3 carries the automatic locking detent 6 one end of which extends from a slide side so as to act as a release push-button.

From a side of the slide also the adjusting screw head of an eccentric shaft 7 extends which, as it is rotated by means of a screw-driver, controls the anchoring pressure of the bracelet portion 1. Interposed between the eccentric shaft 7 and the bracelet 1 is a blade 8 serving to increase the pressure surface contacting the bracelet 1 in order to obtain a better anchoring action of the bracelet.

Furthermore, in order to prevent the bracelet from sliding after it has been adjusted and locked, on the bottom of the slide 3 recesses 3' are provided intended to cooperate with corresponding complementary recesses 1' provided in the bracelet, particularly in the case it is of metal or an easily sliding material.

The clasping and unclasping means in which the tooth 5 engages is comprised of a detent 6 provided with a cutout and positioned below a bridge element also provided with a cutout and positioned transverse the slide, said detent being subjected to the bibs of a spring 10 tending to urge the detent outside the slide 3. The externally extending end acts as a release push-button whereas the cutouts of the bridge element 9 and the detent 6 overlapping to each other are intended to receive and retain the tooth 5.

As it is clasped the tooth 5 pushes the detent 6 against the action of the spring 10 thereby permitting the return of the automatic lock.

The housing of the spring 10 and the detent 6 in the proper position when mounted is permitted by the screw 11 which projects from the bridge element 9 and locates into a notch 6' of the detent 6.

While an embodiment only has been described, it is apparent to those skilled in the art that various changes and modifications can be made thereto without departing from the scope of the appended claims.

What I claim is:

1. An adjusting and locking device for a watch bracelet comprising an adjusting and locking slide, said slide being connected to an end of one half of the bracelet and comprising a bottom, two opposite sides said device further comprising, a plate pivotally connected to an end of a second half of the bracelet, a rotatable eccentric shaft arranged transversely to the slide to control anchoring pressure of said slide to the bracelet half portion, a blade arranged between the eccentric shaft and the bracelet surface to increase contact pressure surfaces, a tooth, said tooth projecting from the inner surface of the plate, a bridge element, said bridge element arranged transverse the opposite edges of the slide, and provided with a cutout and a detent elastically arranged transverse to the opposite sides of the slide, below the bridge element, having an end extending outside the slide and being provided with a cutout corresponding to the cutout of the bridge element and wherein the tooth of the plate is received and retained.

* * * * *